US011913714B2

(12) United States Patent
Jette et al.

(10) Patent No.: US 11,913,714 B2
(45) Date of Patent: Feb. 27, 2024

(54) DILUTION REFRIGERATOR WITH CONTINUOUS FLOW HELIUM LIQUEFIER

(71) Applicant: ANYON SYSTEMS INC., Dorval (CA)

(72) Inventors: François-Xavier Jette, Longueuil (CA); Justin Huneault, Montréal (CA)

(73) Assignee: ANYON SYSTEMS INC., Dorval (CA)

( * ) Notice: Subject to any disclaimer, the term of this patent is extended or adjusted under 35 U.S.C. 154(b) by 0 days.

(21) Appl. No.: 18/051,992

(22) Filed: Nov. 2, 2022

(65) Prior Publication Data

US 2023/0135323 A1 May 4, 2023

Related U.S. Application Data

(60) Provisional application No. 63/274,633, filed on Nov. 2, 2021.

(51) Int. Cl.
*F25J 1/00* (2006.01)
*F25B 9/12* (2006.01)
(Continued)

(52) U.S. Cl.
CPC ..... *F25J 1/0007* (2013.01); *F25B 9/10* (2013.01); *F25B 9/12* (2013.01); *F25B 9/14* (2013.01); *F25D 19/006* (2013.01)

(58) Field of Classification Search
CPC ..... F25B 9/10; F25B 9/12; F25B 9/14; F25J 1/0007; F25D 19/006
See application file for complete search history.

(56) References Cited

U.S. PATENT DOCUMENTS 4,672,823 A * 6/1987 Benoit ..... F17C 3/085 62/50.1
5,381,666 A 1/1995 Shao et al.
(Continued)

FOREIGN PATENT DOCUMENTS

JP 2003194428 7/2003

OTHER PUBLICATIONS

International Search Report and Written Opinion dated Feb. 21, 2023, International Application No. PCT/CA2022/051619 filed Nov. 2, 2022.
(Continued)

*Primary Examiner* — Brian M King
(74) *Attorney, Agent, or Firm* — NORTON ROSE FULBRIGHT CANADA LLP

(57) ABSTRACT

A dilution refrigerator, such as for a quantum computing system, includes a cryostat having a plurality of temperature-controlled flanges inside a vacuum chamber. A dilution unit is disposed inside the cryostat and operable to cool a first group of the flanges. A continuous flow helium refrigerator is in heat transfer communication with a lowest temperature flange of a second group of flanges, disposed at progressively lower temperatures that are greater than those of the first group of flanges, to provide primary cooling thereto to a first temperature. The continuous flow helium refrigerator resides at least partially in the cryostat and includes a helium liquefier and a first closed-loop circuit thermally coupling the helium liquefier to the lowest temperature flange of the second group of flanges. The helium liquefier provides liquid helium to the lowest temperature flange of the second group of flanges via the first closed-loop circuit.

21 Claims, 11 Drawing Sheets

(51) Int. Cl.

| | |
|---|---|
| ***F25B 9/10*** | (2006.01) |
| ***F25B 9/14*** | (2006.01) |
| ***F25D 19/00*** | (2006.01) |

(56) References Cited

U.S. PATENT DOCUMENTS

| | | | | |
|---|---|---|---|---|
| 2005/0104700 | A1 | 5/2005 | Mulder | |
| 2005/0126187 | A1 | 6/2005 | Li et al. | |
| 2007/0051116 | A1 | 3/2007 | Glemot et al. | |
| 2009/0049862 | A1 | 2/2009 | Wang | |
| 2009/0049863 | A1 | 2/2009 | Wang | |
| 2011/0173996 | A1 | 7/2011 | Glajchen et al. | |
| 2011/0179811 | A1 | 7/2011 | Bohn et al. | |
| 2012/0167598 | A1 | 7/2012 | Diederichs et al. | |
| 2013/0047632 | A1 | 2/2013 | Rillo Millan et al. | |
| 2013/0192273 | A1 | 8/2013 | Rillo Millan et al. | |
| 2014/0374054 | A1 | 12/2014 | Xu et al. | |
| 2015/0007586 | A1* | 1/2015 | Kraus | F25D 19/00 62/51.1 |
| 2015/0027155 | A1 | 1/2015 | Maruyama | |
| 2015/0047377 | A1 | 2/2015 | Hamasaki et al. | |
| 2015/0253042 | A1 | 9/2015 | Matsui | |
| 2015/0345860 | A1 | 12/2015 | Rillo Milan et al. | |
| 2016/0097567 | A1 | 4/2016 | Hiratsuka | |
| 2019/0188596 | A1 | 6/2019 | Ipek et al. | |
| 2019/0341173 | A1 | 11/2019 | Smith et al. | |
| 2019/0341174 | A1 | 11/2019 | Smith et al. | |
| 2020/0370792 | A1* | 11/2020 | Matthews | F25B 9/12 |
| 2021/0301979 | A1 | 9/2021 | Wikus | |
| 2021/0326739 | A1 | 10/2021 | Jeffrey | |
| 2021/0402407 | A1* | 12/2021 | Hoehne | F25B 9/10 |
| 2023/0107973 | A1* | 4/2023 | Crispel | F25B 1/00 62/115 |

OTHER PUBLICATIONS

Third Party Observation filed Jun. 29, 2023, International Application No. PCT/CA2022/051619 filed Nov. 2, 2022.

Matthew Hollister, Ram Dhuley, Grzegorz Tatkowski, A large millikelvin platform at Fermilab for quantum computing applications published Aug. 24, 2021, https://arxiv.org/abs/2108.10816.

SW Van Sciver, Cryogenic Engineering: Fifty Years of Progress, National High Magnetic Field Laboratory, FSU, Springer Science & Business Media, 2007, p. 162.

* cited by examiner

DILUTION REFRIGERATOR WITH CONTINUOUS FLOW HELIUM LIQUEFIER

CROSS-REFERENCE TO RELATED APPLICATIONS

The present application claims priority to U.S. Provisional Patent Application No. 63/274,633 filed on Nov. 2, 2021, the entire contents of which are hereby incorporated herein by reference.

TECHNICAL FIELD

The disclosure generally relates to the field of cryogenics. More specifically, the present disclosure relates to dilution refrigerators.

BACKGROUND

Quantum computers are machines that harness the properties of quantum states, such as superposition, interference, and entanglement, to perform computations. In a quantum computer, the basic unit of memory is a quantum bit, or qubit. Superconducting qubits are one of the most promising candidates for developing commercial quantum computers. Indeed, superconducting qubits can be fabricated using standard microfabrication techniques. Moreover, they operate in the few GHz bandwidth such that conventional microwave electronic technologies can be used to control qubits and readout the quantum states. However, superconducting qubits need to operate at temperatures dose to absolute zero. This requires cryogenic refrigeration systems with multiple stages of cooling.

A quantum computer with enough qubits has a computational power inaccessible to a classical computer, which is referred to as "quantum advantage". As the number of qubits in a quantum computer scales, the cryogenic refrigeration systems need to provide increased cooling capacity. Therefore, improvements are needed.

SUMMARY

There is accordingly provided, in accordance with one aspect, a dilution refrigerator comprising: a cryostat comprising a plurality of temperature-controlled flanges inside a vacuum chamber, the temperature-controlled flanges including a first group of flanges cooled to a first set of progressively lower temperatures and a second group of flanges cooled to a second set of progressively lower temperatures that are higher than the first set of progressively lower temperatures; a dilution unit disposed inside the cryostat and operable to cool the first group of flanges to the first set of progressively lower temperatures; and a continuous flow helium refrigerator in heat transfer communication with a lowest temperature flange of the second group of flanges to provide primary cooling thereto to a first temperature, the continuous flow helium refrigerator residing at least partially in the cryostat and comprising a helium liquefier and a first closed-loop circuit thermally coupling the helium liquefier to the lowest temperature flange of the second group of flanges, the helium liquefier including a compressor, an expander downstream from the compressor, at least one heat exchanger between the compressor and the expander, and a liquid helium reservoir downstream from the expander and providing liquid helium to the lowest temperature flange of the second group of flanges via the first closed-loop circuit.

The dilution refrigerator as defined above and described herein may further include one or more of the following features, in whole or in part, and in any combination.

In certain aspects, the continuous flow helium refrigerator further comprises a second closed-loop circuit thermally coupled to the at least one heat exchanger, the second closed-loop circuit thermally coupling the continuous flow helium refrigerator to one or more flanges of the second group of flanges to provide cooling thereto to a second temperature.

In certain aspects, the second closed-loop circuit provides liquid nitrogen to the one or more flanges of the second group of flanges.

In certain aspects, the second closed-loop circuit diverts compressed helium gas exiting the compressor to cool the one or more flanges of the second group of flanges to the second temperature.

In certain aspects, a second expander is coupled to an inlet and an outlet of the compressor.

In certain aspects, a pulse tube cryocooler provides additional cooling to the second group of flanges at a second temperature higher than the first temperature.

In certain aspects, the helium liquefier further includes a second expander and a second heat exchanger, the second heat exchanger operable to cool, via liquid helium in the liquid helium reservoir, a portion of helium diverted downstream of the at least one heat exchanger to a second temperature below the first temperature, and direct the portion of helium through the second expander and through the first closed-loop circuit.

In certain aspects, the helium liquefier further includes a second liquid helium reservoir thermally coupled to a second heat exchanger, the second liquid helium reservoir operable to receive a portion of liquid helium from the liquid helium reservoir, with a remainder of the liquid helium from the liquid helium reservoir diverted to the second heat exchanger to cool the portion of liquid helium before the portion of liquid helium is directed through the first closed-loop circuit.

In certain aspects, the dilution unit includes a second liquid helium reservoir thermally coupled to a second heat exchanger and disposed in the first group of flanges, the second liquid helium reservoir operable to receive liquid helium from the liquid helium reservoir and provide cooling, via the second heat exchanger, to a flange of the second group of flanges and/or a supply line to the dilution unit.

In certain aspects, the expander, the at least one heat exchanger, and the liquid helium reservoir are disposed inside the cryostat.

There is also provided, in accordance with another aspect, a dilution refrigerator comprising: a cryostat comprising a plurality of temperature-controlled flanges inside a vacuum chamber, the temperature-controlled flanges composed of a first group of flanges cooled to a first set of progressively lower temperatures and a second group of flanges cooled to a second set of progressively lower temperatures that are higher than the first set of progressively lower temperatures; a dilution unit disposed inside the cryostat and operable to cool the first group of flanges to the first set of progressively lower temperatures; and a continuous flow helium refrigerator in heat transfer communication with a lowest temperature flange of the second group of flanges to maintain the lowest temperature flange at a first temperature of 2.5 K to 5 K using a recuperative thermodynamic cycle, the continuous flow helium refrigerator residing at least partially in the cryostat and including a helium liquefier and a first closed-loop circuit fluidly interconnecting the helium liquefier and the lowest temperature flange of the second group of flanges.

The dilution refrigerator as defined above and described herein may further include one or more of the following features, in whole or in part, and in any combination.

In certain aspects, the continuous flow helium refrigerator further comprises a second closed-loop circuit thermally coupled to the helium liquefier, the second closed-loop circuit thermally coupling the continuous flow helium refrigerator to one or more flanges of the second group of flanges to provide cooling thereto to a second temperature.

In certain aspects, the second closed-loop circuit diverts compressed helium gas from the helium liquefier to cool the one or more flanges of the second group of flanges to the second temperature.

In certain aspects, a pulse tube cryocooler provides additional cooling to the second group of flanges at a second temperature higher than the first temperature.

In certain aspects, the helium liquefier includes a compressor, an expander downstream from the compressor, at least one heat exchanger between the compressor and the expander, and a liquid helium reservoir downstream from the expander and providing liquid helium to the lowest temperature flange of the second group of flanges via the first closed-loop circuit.

In certain aspects, a second expander is coupled to an inlet and an outlet of the compressor.

In certain aspects, the helium liquefier further includes a second expander and a second heat exchanger, the second heat exchanger operable to cool, via liquid helium in the liquid helium reservoir, a portion of helium diverted downstream of the at least one heat exchanger to a second temperature below the first temperature, and direct the portion of helium through the second expander and through the first closed-loop circuit.

In certain aspects, the helium liquefier further includes a second liquid helium reservoir thermally coupled to a second heat exchanger, the second liquid helium reservoir operable to receive a portion of liquid helium from the liquid helium reservoir, with a remainder of the liquid helium from the liquid helium reservoir diverted to the second heat exchanger to cool the portion of liquid helium before the portion of liquid helium is directed through the first closed-loop circuit.

In certain aspects, the dilution unit includes a second liquid helium reservoir thermally coupled to a second heat exchanger and disposed in the first group of flanges, the second liquid helium reservoir operable to receive liquid helium from the liquid helium reservoir and provide cooling, via the second heat exchanger, to a flange of the second group of flanges and/or a supply line to the dilution unit.

In certain aspects, the expander, the at least one heat exchanger, and the liquid helium reservoir are disposed inside the cryostat.

There is further provided, in accordance with another aspect, a continuous flow helium refrigerator for a dilution refrigerator of a quantum computing system, comprising: a helium liquefier including a compressor, an expander downstream from the compressor, at least one heat exchanger between the compressor and the expander, and a liquid helium reservoir downstream from the expander; and a closed-loop circuit thermally coupling the helium liquefier to a flange of the dilution refrigerator; wherein the helium liquefier is operable to maintain the flange of the dilution refrigerator at a temperature of 2.5 K to 5 K.

The continuous flow helium refrigerator for a dilution refrigerator as defined above and described herein may further include one or more of the above-noted features, in whole or in part, and in any combination.

Many further features and combinations thereof concerning the present improvements will appear to those skilled in the art following a reading of the instant disclosure.

DETAILED DESCRIPTION

Figure 1:
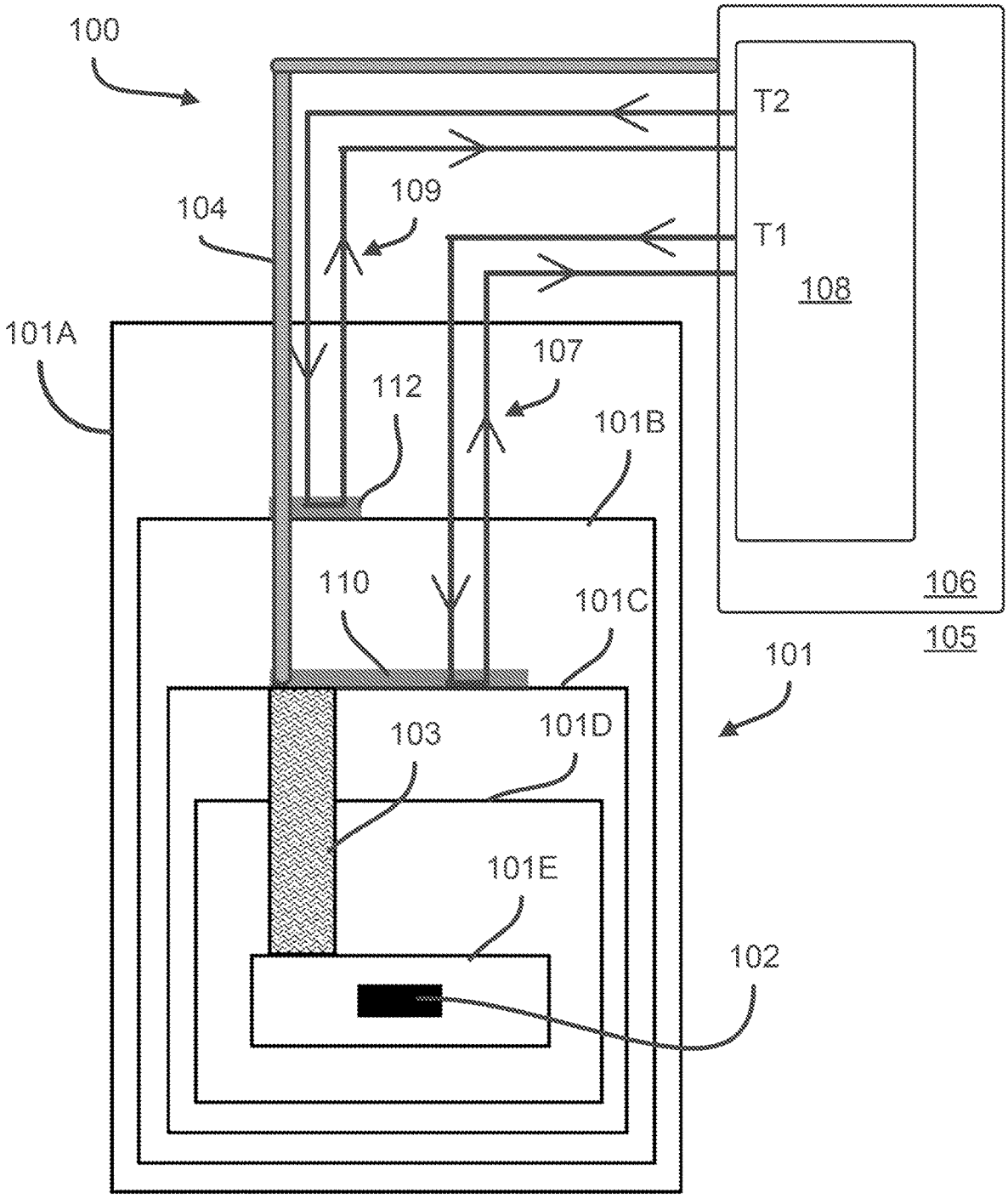
FIG. 1 is a schematic view of a dilution refrigerator according to an embodiment.

Dilution refrigerators are cryogenic devices that provide continuous cooling in a cryostat from ambient temperature all the way down to millikelvin temperatures without any moving part at the low temperature stages (below 3 Kelvin (K)).

Dilution refrigerators may comprise a number of temperature stages used to thermally anchor radiation shields and wiring in order to reduce the amount of heat leaking to the colder stages. Aside from a room-temperature (300 K) stage, there can be, for example, stages at 50 K, 10 K, and 4 K, and additional stages at temperatures below 1 K. The cooling of these stages, or "flanges", may be achieved by one or more different cooling systems including, for example, dilution units and pulse tube cryocoolers.

The pulse tube cryocooler serves many purposes. It is typically used 1) to cool and maintain the 50 K, 10 K, and 4 K stages at their cold temperature, 2) to achieve the initial cool down of the coldest stages of the dilution refrigerator to around 4 K prior to activating the dilution unit, and 3) to cool circulating 3He (Helium-3, a stable isotope of Helium (He)) from ambient temperature to 4 K during the steady state operation of the dilution unit.

Dilution refrigerators are used in various applications, including low temperature detectors, superconductivity research, low temperature solid state physics, and quantum computing. The latter is a rapidly developing field which will require larger and larger cryogenic systems as the number of qubits in quantum processors increases. For example, in some cases superconducting quantum computers use coaxial cables to route signals from room temperature electronics to the quantum processor in the dilution refrigerator. As the number of cables scales linearly with the number of qubits, a larger number of qubits will result in more cables in the cryostat. The space occupied by the cables may require larger cryostats, and the heat leak through the cables to the lower temperature stages of the cryostat may require a greater flow rate of 3He through the dilution unit to provide more cooling power. The increased conductive heat leak through the cables and supports, radiative heat leak to the larger radiation shields, and heat load from increased 3He circulation mean that the cooling power provided by the pulse tube cryocooler will also need to be increased.

However, the cooling power of pulse tube cryocoolers does not scale easily. Indeed, flow instabilities in larger tubes make it very difficult to make more powerful pulse tubes. Hence, making larger pulse tubes is not practical and additional cooling power is provided by multiple pulse tubes. However, this solution does not scale well since 1) multiple pulse tubes require additional space inside the cryostat, where space is usually limited, and 2) power consumption, the amount and cost of the regenerator material and the number and/or size of compressors scale linearly with the number of pulse tubes.

In the present disclosure, a dilution refrigerator is provided that includes a continuous flow helium liquefier, which is a recuperative-type cooling device, for providing primary cooling to one or more flanges of the dilution refrigerator. In accordance with some embodiments of the present disclosure, the pulse tube cryocooler typically used for cooling one or more flanges of a dilution refrigerator may be replaced by the continuous flow helium liquefier. In other embodiments, the continuous flow helium liquefier provides primary cooling for one or more flanges, and a pulse tube cryocooler may be used to provide supplemental, albeit secondary, cooling. For a given capital cost and electrical power consumption, continuous flow helium liquefiers can provide higher cooling power than pulse tube cryocoolers. For example, a continuous flow helium liquefier can provide 100 to 1000 W of cooling power at 4.5 K while consuming 50 to 300 kW of electrical power whereas a pulse tube cryocooler provides 2 to 3 W of cooling at 4.2 K with 12.5 kW of electricity.

FIG. 1 shows an embodiment fora dilution refrigerator 100. The dilution refrigerator 100 comprises a cryostat 101 having temperature-controlled flanges, illustratively five flanges 101A, 101B, 101C, 101D and 101E defining five temperature stages of decreasing temperature. The flange 101A, also called an outer vacuum can or vacuum chamber, is at the 300 K stage while flanges 101B, 101C, 101D and 101E can, for example, be at the 50 K, 4 K, 800 mK, and 8 mK stages. These temperatures are exemplary, and other temperature stages may be contemplated. Flanges 101B, 101C, 101D and 101E need not be perfectly sealed. These flanges may serve for supporting radiation shields as well as for thermal anchoring of other components of the dilution refrigerator 100. The flanges 101A, 101B, 101C, 101D and 101E can be made of plates (where components can be affixed). In some embodiments, the plates also act as radiation shields. Additional thermal anchoring stages which may not take the form of a flange may also be present, for example at the 800 mK stage. Other embodiments may have a different number of flanges at different temperatures. A device 102 resides inside the coldest flange 101E. The device 102 can, for example, be a quantum processor. Note that some of the temperature stages illustrated as flanges in FIG. 1, for example the flange 101E, could also alternatively take the shape of an open structure. In some cases, the flanges 101A-101E may take the form of nested enclosures, where the innermost flange is at a lowest temperature and the outermost flange is at a highest temperature, with intermediate flanges being maintained at progressively lower temperatures from the outermost flange towards the innermost flange.

Cooling of the lower temperature stages, such as those defined by flanges 101D, 101E, is provided by a dilution unit 103, which is schematically represented by a simple rectangle in FIG. 1. The dilution unit 103 may comprise a mixing chamber, liquid counter flow (recuperative) heat exchangers, a still and a condenser, which can be a vapor counter flow (recuperative) heat exchanger, or a liquid 4He heat exchanger coupled to a liquid 4He bath supplied via a separate circulation circuit. The dilution unit 103 is supplied by a 3He supply line 104 which is thermally anchored at different temperature stages and in some cases connected to a gas handling system 105 outside the cryostat 101. A pumping line used to extract 3He from the cryostat 101 towards the gas handling system 105 is not illustrated for clarity.

The dilution unit 103 provides cooling power by the energy required to mix two isotopes of helium, liquid 3He and 4He. Indeed, at low temperature, the mixture of both isotopes separates into two phases: a 3He rich phase and a 4He rich phase. When liquid 3He is circulated into a mixing chamber containing 4He, it mixes with the 4He rich phase which requires energy and thus removes heat from the mixing chamber's environment.

Continuous cooling power is produced by circulating 3He, for example using vacuum pumps located in a gas handling system outside the cryostat, such that 3He evaporated from the 3He/4He mixture is returned to the dilution unit 103 to be condensed before entering the mixing chamber again. The dilution unit 103 comprises a condenser to turn the gaseous 3He supply to liquid 3He. The condenser can be a recuperative heat exchanger cooled by the enthalpy of the 3He evaporated from the still. Alternatively, the condenser can be a heat exchanger cooled by a liquid 4He bath at a temperature around 1 K.

In operation, the dilution unit 103 and the 3He supply are first cooled from room temperature, and then maintained at temperatures close to liquid helium temperature (4.2 K) to condense the incoming 3He supply in the condenser.

In cases where the device 102 employs electronic control from outside the cryostat 101, as is the case for quantum processors, the cryostat 101 can be wired with control cables thermally anchored at each temperature stage through various heat exchangers similarly to the 3He supply line 104.

The flanges 101A-101E may be split into a first group of flanges cooled to a first set of progressively lower temperatures and a second group of flanges cooled to a second set of progressively lower temperatures that are higher than the first set of progressively lower temperatures. Illustratively, flanges 101D and 101E form the first group of flanges and are cooled by the dilution unit 103, whereas flanges 101A-101C form the second group of flanges and may be cooled via various means, as will be discussed in further detail below.

Primary cooling of one or more of the flanges of the cryostat 101, and in particular the innermost flange 101C of the second group of flanges (i.e., the lowest temperature flange of the second group of flanges), is provided by a continuous flow helium refrigerator 106 as will now be described. The helium refrigerator 106 includes a first closed loop piping circuit 107 and a helium liquefier 108, the first closed loop piping circuit 107 provided between the helium liquefier 108 and the cryostat 101. For example, the piping circuit 107 is coupled to flange 101C through heat exchanger 110 so that the helium liquefier 108 is thermally coupled to the flange 101C. As helium flows through the first closed loop piping circuit 107, it circulates through the heat exchanger 110, thus cooling the flange 101C. The first closed loop piping circuit 107 can also be used to cool the dilution unit 3He supply line 104, for example by coupling the 3He supply line 104 to the heat exchanger 110. Other heat exchangers may be used to couple the 3He supply line 104 to the first closed loop piping circuit 107.

In some embodiments, a second closed loop piping circuit 109 is provided between the helium liquefier 108 and the cryostat 101. For example, the piping circuit 109 is coupled to flange 101B through a heat exchanger 112. As helium flows through the second closed loop piping circuit 109, it circulates through the heat exchanger 112, thus cooling the flange 101B. The second closed loop piping circuit 109 can also be used to cool the dilution unit 3He supply line 104, for example by coupling the 3He supply line 104 to the heat exchanger 112. Other heat exchangers may be used to couple the 3He supply line 104 to the second closed loop piping circuit 109.

The helium flowing out of the helium liquefier 108 and into the first closed loop piping circuit 107 flows at a first temperature T1. The helium flowing out of the helium liquefier 108 and into the second closed loop piping circuit 109 flows at a second temperature T2>T1. In this manner, flange 101C is cooled to a temperature that is lower than the temperature to which flange 101B is cooled. For example, flange 101C may be cooled to 4 K and flange 101B may be cooled to 50 K. Other temperatures values are also considered. For instance, in various embodiments, flange 101C may be cooled to temperatures varying between about 2.5 K to 5 K. The helium liquefier 108 may be operable to provide primary cooling to the flange 101C, i.e., capable of cooling the flange 101C to its target temperature (e.g., to about 2.5 K to 5 K, and preferably to about 4 K) without the need for other cooling means such as pulse tubes. This cooling power and the ability of the helium liquefier 108 to operate independently from other cooling means comes from the use of a recuperative cycle to liquefy helium. Some of the compressed helium is quasi-isentropically expanded, and the cooling that comes from the expansion allows the cycle to operate independently. This arrangement can readily be scaled up to large flow rates so as to provide large cooling powers.

Figure 2A:
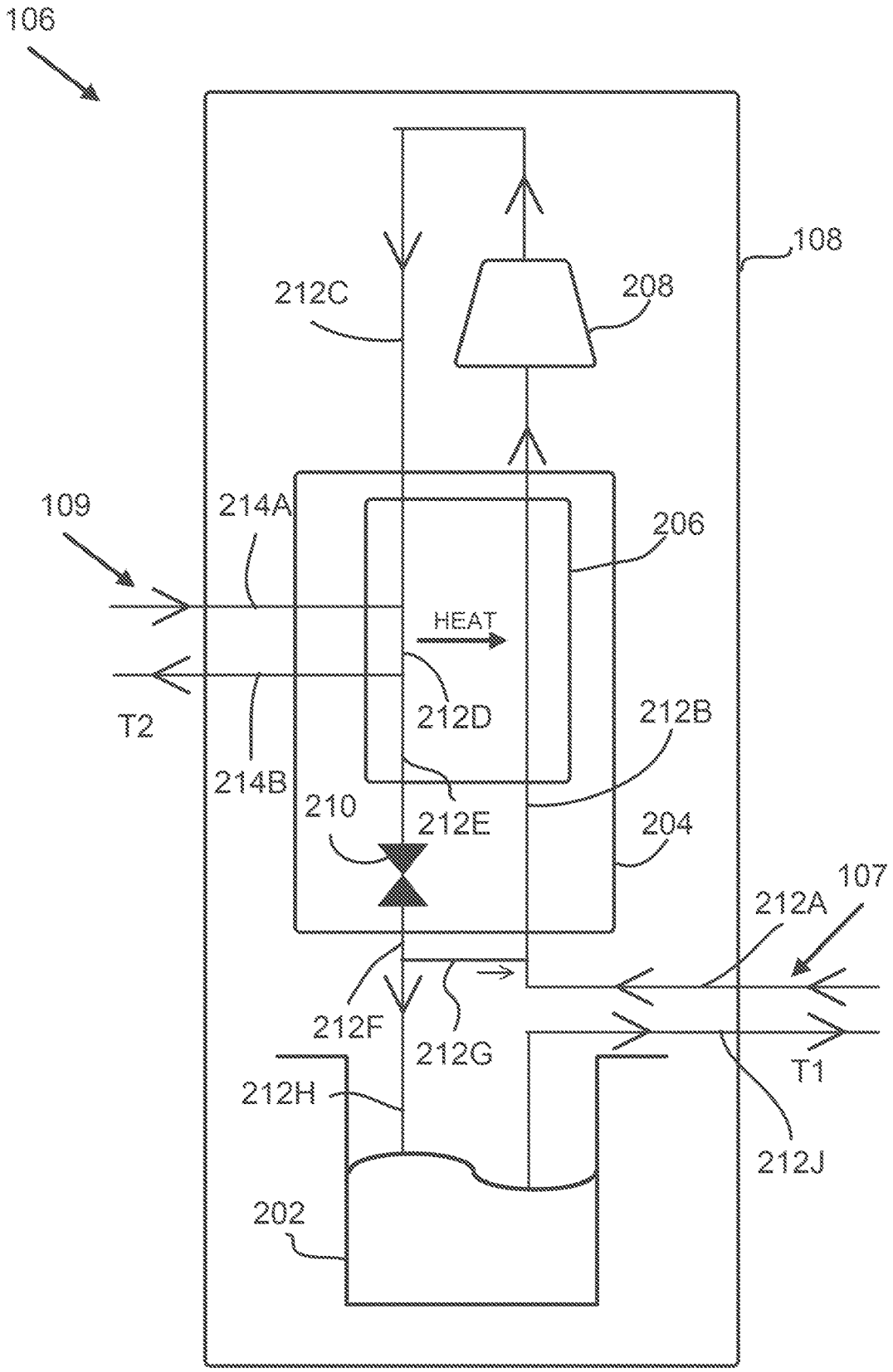
FIGS. 2A-2C are schematic views of exemplary continuous flow helium liquefiers for the dilution refrigerator of FIG. 1.

With reference to FIG. 2A, there is illustrated an example embodiment for the helium liquefier 108. In this example, the helium liquefier 108 uses a recuperative cycle (for example the Linde-Hampson cycle) because cold gas is recuperated via a heat exchanger to cool down an incoming compressed gas. Indeed, a cold block 204 comprises a heat exchanger 206 and an expander 210, illustratively an expansion valve. Other types of expanders 210 may be contemplated, for instance an expansion turbine, a piston expander, and a throttling valve. The first closed loop piping circuit 107 has an incoming branch 212A and an outgoing branch 212J. Helium gas coming in through the incoming branch 212A is used to cool a compressed version of that same gas that has passed through a compressor 208 and is flowing down into the heat exchanger 206 in the opposite direction. More specifically, gas coming in through branch 212A combines with gas flowing through branch 212G to form gas flowing in branch 212B through the heat exchanger 206. The gas through branch 212B gets compressed by the compressor 208 and flows back into the heat exchanger 206 through branch 212C. The gas through branch 212C mixes with incoming gas through branch 214A coming from the second closed loop piping circuit 109 to form the gas in branch 212D, which then gets split between branch 214B and branch 212E (for example using a pump and an orifice or an adjustable valve). Gas in branch 214B is flowing out to the cryostat 101 via the second closed loop piping circuit 109. Gas through branch 212E flows through the expander 210, resulting in a mixture of liquid and gas in branch 212F. Most of the gas from branch 212F gets directed to branch 212G, most of the liquid from branch 212F gets directed to branch 212H and flows into a reservoir 202.

More generally, the helium liquefier 108 includes a compressor 208, an expander 210 downstream from the compressor 208, at least one heat exchanger 206 between the compressor 208 and the expander 210, and a liquid helium reservoir 202 downstream from the expander 210 and providing liquid helium to the lowest temperature flange 101C of the second group of flanges via a closed-loop circuit 107. It will be understood that the embodiment illustrated in FIG. 2A requires the helium flowing within the helium liquefier 108 to be cold enough for the recuperative cycle to begin. In certain embodiments of the expander 210, for example as a piston expander or a turbine, no additional assistance is needed. In other embodiments of the expander 210, for example as a valve, additional assistance may be provided using one or more additional component within the continuous flow helium refrigerator 106 or externally thereto to cool the helium flowing in the closed-loop circuit 107 to a given initial temperature until the cycle can become self-sustaining.

Cold helium flows out of branch 212J at about 4 K to cool the flange 101C through heat exchanger 110 and returns to the helium liquefier 108 through branch 212A. This helium then passes through the heat exchanger 206 via branch 212B to cool compressed gas flowing out of the helium liquefier 108 through branch 214B at about 50 K. In some embodiments, an adjustable valve or an orifice may be provided on incoming branch 212A, outgoing branch 212J and/or branch 212G in order to control the flow rate in the first closed loop piping circuit 107. It will be understood that various pumps, which are omitted from FIG. 2A for clarity, are used to allow the gas and/or liquid to flow in the indicated directions, in view of the various pressure levels present in the different branches of the piping circuits. Also omitted for clarity are the different chambers at different temperature stages within the cold box 204.

Figure 2B:
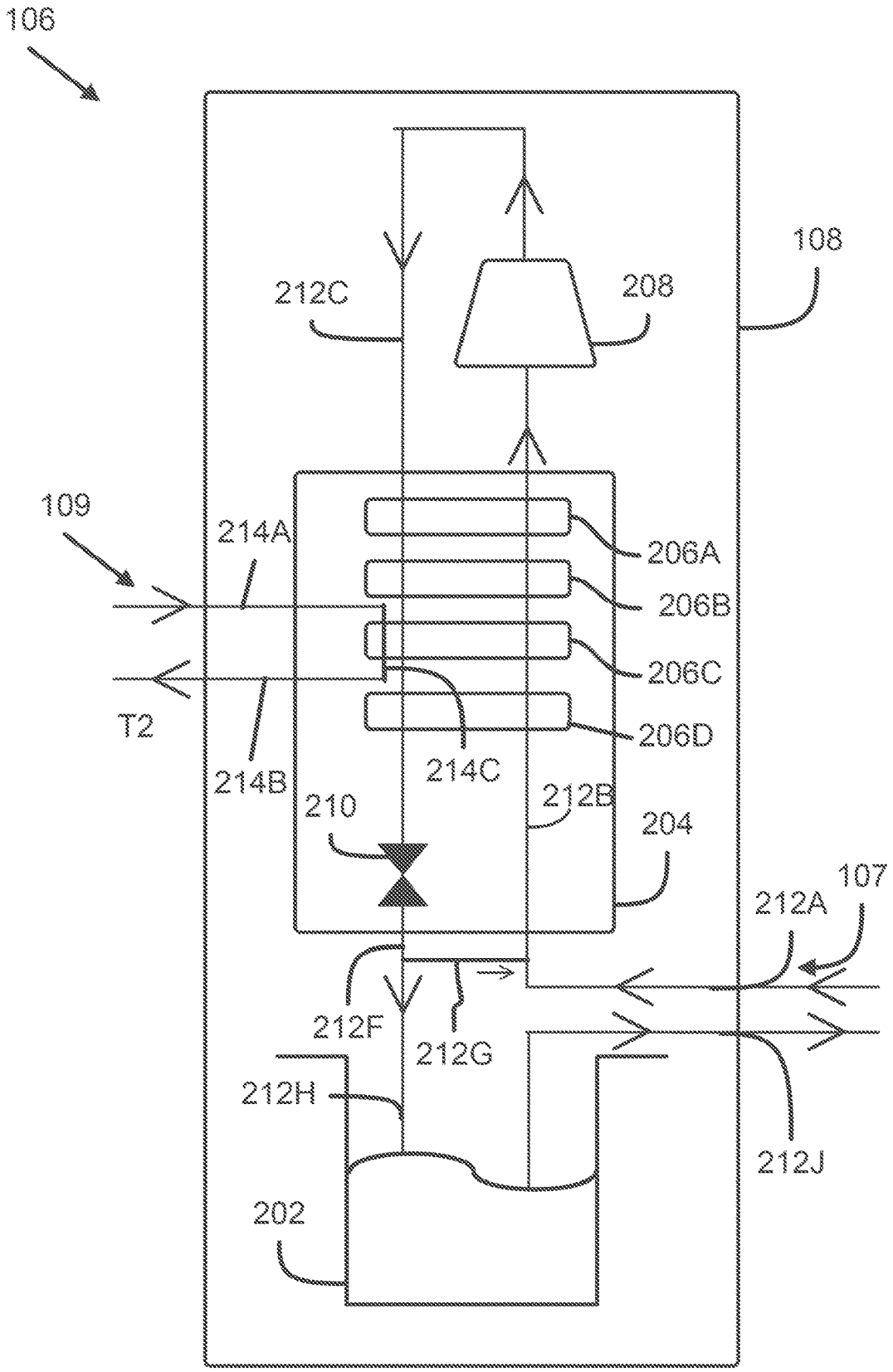

In some embodiments, the heat exchanger 206 may be replaced by a plurality of heat exchangers 206A, 206B, 206C, 206D as illustrated in the example of FIG. 2B. Gas flowing through branch 212B flows through the heat exchangers 206A, 206B, 206C, 206D in a first direction, gas flowing through branch 212C flows through the heat exchangers 206A, 206B, 206C, 206D in a second direction opposite the first direction. Another variant to the embodiment of FIG. 2A is shown in FIG. 2B, where branches 214A and 214B of the second closed loop piping circuit 109 are coupled through branch 214C that flows gas through heat exchanger 206C and gets cooled by compressed gas flowing through branch 212C. Other variants may also be provided, such as more or less heat exchangers and additional gas expanders to cool the helium in the closed-loop circuit 107 to a given initial temperature until the cycle can become self-sustaining.

In embodiments where the second closed loop piping circuit 109 is independent from the circuit through which the helium flows within the helium liquefier 108, as shown in FIG. 2B, a liquid substance may flow through the second closed loop piping circuit 109 instead of gaseous helium. Indeed, any substance in a liquid state at the temperature and pressure of the second closed loop piping circuit 109 will provide good heat transfer through heat exchanger 112 in the cryostat 101 and through heat exchanger 206C in the helium liquefier 108.

Figure 2C:
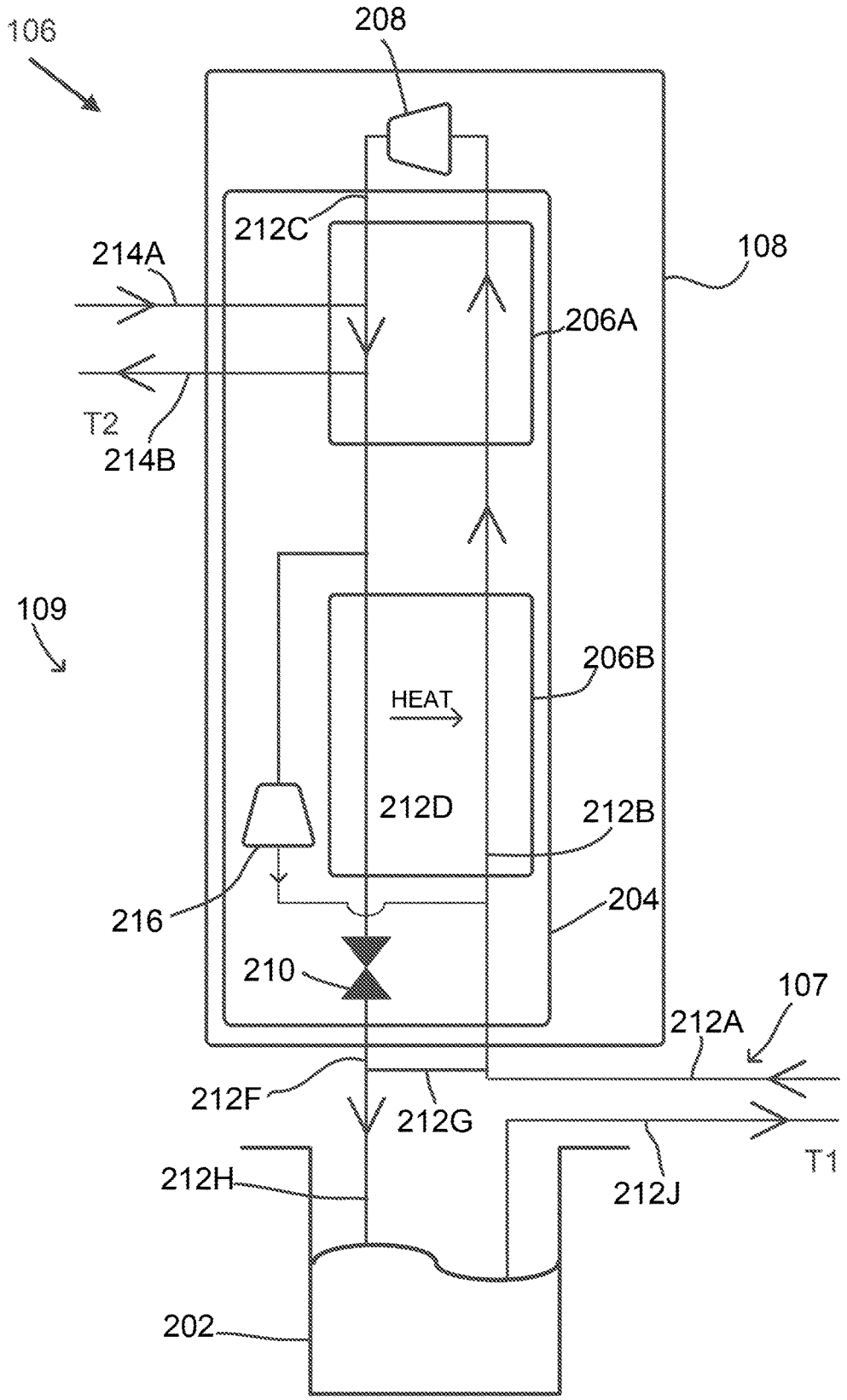

With reference to FIG. 2C, there is illustrated another example for the helium liquefier 108. In this example, the helium liquefier uses a variation of the Linde-Hampson cycle, referred to as the Claude cycle. As in the case of the helium liquefier 108 shown in FIG. 2A, the Claude cycle type liquefier of FIG. 2C may be referred to as a recuperative cycle because cold gas is recuperated via a heat exchanger to cool down an incoming compressed gas. The helium refrigerator 106 shown in FIG. 2C includes two stages of heat exchangers 206A, 206B, defining two temperature stages. The second stage heat exchanger 206B, along with expander 210, are located inside cold block or chamber 204. The helium refrigerator 106 further includes compressor 208 and liquid helium reservoir 202. In addition, an expansion turbine 216 is provided in conjunction with heat exchanger 206B. Expansion turbine 216 is operable to extract work from the working fluid in order to increase the cooling of the compressed gas. After the compressed gas exits the first heat exchanger 206A and before entering second heat exchanger 206B, a portion of the compressed gas is diverted to the expansion turbine 216 (for example using orifices/valves) to be expanded before being returned to the cold, low-pressure side of the second heat exchanger 206B. This may aid in the cooling of the hot compressed gas in heat exchanger 206B while maintaining a sufficiently high pressure in the main helium flow to allow for liquefaction of the helium across the expander 210.

Figure 3A:
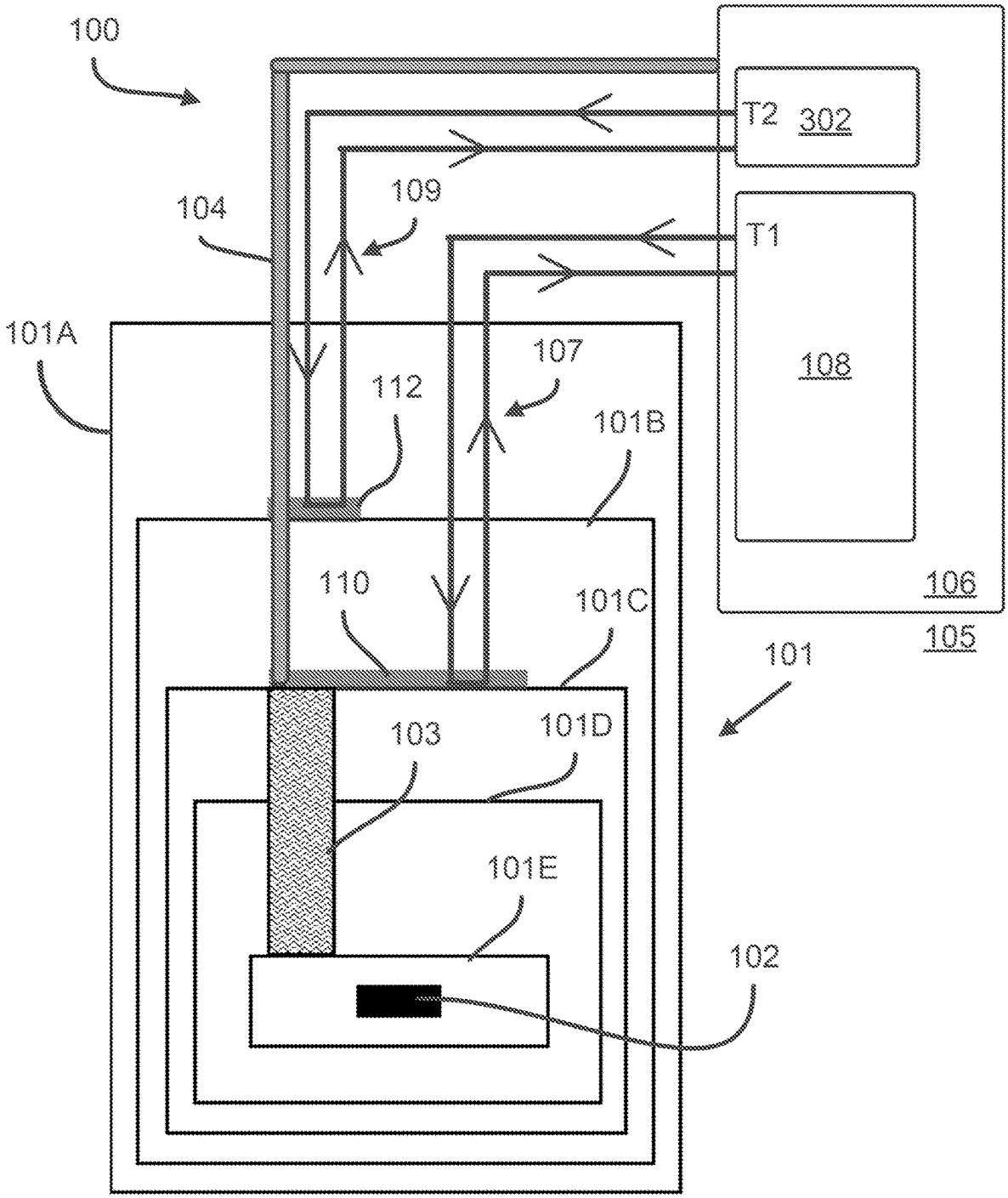
FIG. 3A is a schematic view of a dilution refrigerator according to another embodiment.
Figure 3B:
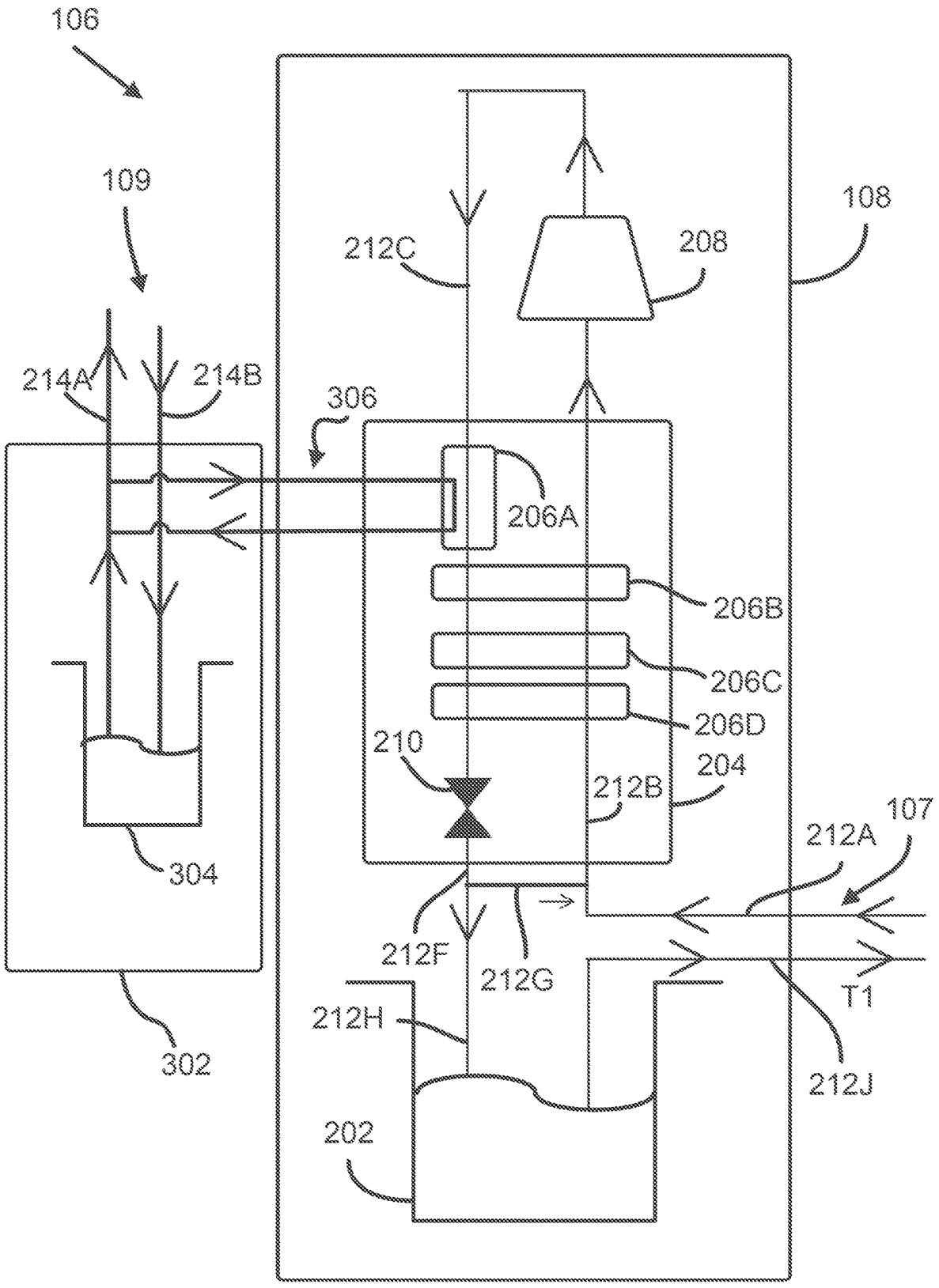
FIG. 3B is a schematic view of an exemplary continuous flow helium liquefier for the dilution refrigerator of FIG. 3A.

In some embodiments, and with reference to FIGS. 3A-3B, a first flange of the cryostat 101 is cooled using the helium liquefier 108 while a second flange of the cryostat 101 is cooled using a different cooling mechanism. For example, one of the flanges may be cooled using liquid nitrogen. As shown in FIG. 3A, the first closed loop piping circuit 107 is coupled between the cryostat 101 and the helium liquefier 108, and cools flange 101C through heat exchanger 110. The helium flowing through the first closed loop piping circuit 107 may also be used to cool the dilution unit 3He supply line 104 through heat exchanger 110 if the 3He supply line 104 is coupled to the heat exchanger 110. The second closed loop piping circuit 109 is coupled between the cryostat 101 and a liquid nitrogen module 302, and cools flange 101B through heat exchanger 112. The liquid nitrogen can also be used to cool the dilution unit 3He supply line 104 through the heat exchanger 112 if the 3He supply line 104 is coupled to the heat exchanger 112.

The liquid nitrogen module 302 forms part of the gas handling system 105 and may be provided separately from or integrated with the helium refrigerator 106. As shown in FIG. 3B, the liquid nitrogen module 302 comprises a liquid nitrogen reservoir 304 from which the liquid nitrogen flows into the second closed loop piping circuit 109 through branch 214A and returns through branch 214B. In some embodiments, the liquid nitrogen can also be used to initially cool helium in the helium liquefier 108 by redirecting part of the liquid nitrogen towards a heat exchanger 206A via circuit 306. Compressed gas carried by branch 212C is cooled by the liquid nitrogen as it flows through the heat exchanger 206A. The various flows of nitrogen may be set using orifices/valves. The liquid nitrogen module 302 can be a nitrogen liquefier based on a closed loop cycle (e.g., the Linde-Hampson cycle) or an open loop system where the liquid nitrogen reservoir 304 is periodically re-filled.

Figure 4:
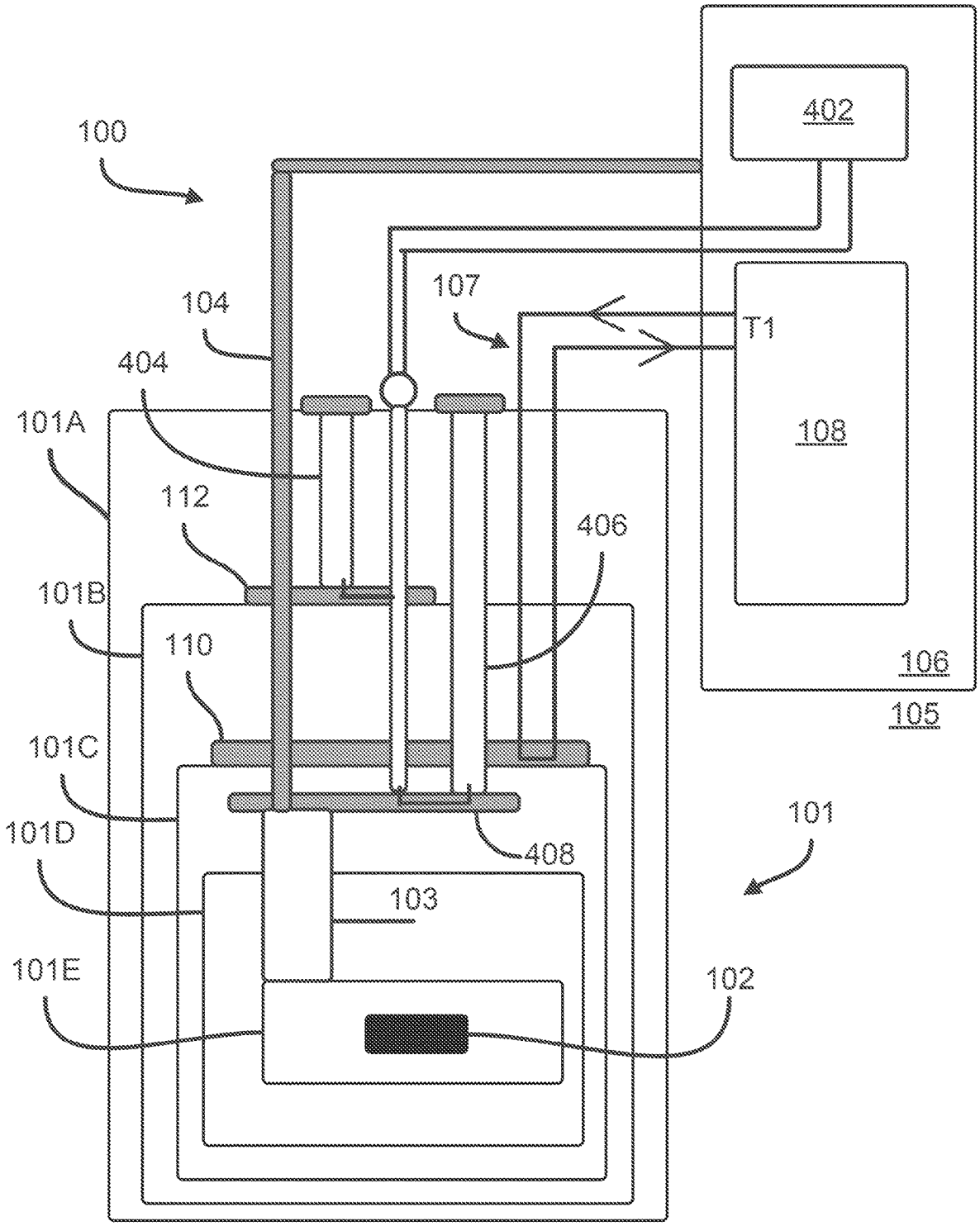
FIG. 4 is a schematic view of a dilution refrigerator according to another embodiment.

In some embodiments, a first flange of the cryostat 101 is cooled using the helium liquefier 108 while a second flange of the cryostat 101 is cooled using a pulse tube cryocooler. An example is shown in FIG. 4, where the first closed loop piping circuit 107 is coupled between the cryostat 101 and the helium liquefier 108, and cools flange 101C through heat exchanger 110. The helium flowing through the first closed loop piping circuit 107 may also be used to cool the dilution unit 3He supply line 104 through heat exchanger 110 if the 3He supply line 104 is coupled to the heat exchanger 110. A first pulse tube 404 of a two-stage pulse tube cryocooler provides cooling to the flange 101B and to the 3He supply line 104 through the heat exchanger 112. A second pulse tube 406 of the two-stage pulse tube cryocooler may be used as a supplement to provide cooling power at a lower temperature to the 3He supply line 104 through a heat exchanger 408. Indeed, although a single pulse tube 404 may be used, a second pulse tube 406 can contribute additional cooling power by further lowering the temperature of the 3He supply line 104 beyond 4 K, for example closer to 2 K.

The pulse tube cryocooler may be driven by its own compressor 402. Alternatively, the helium liquefier 108 and the pulse tube cryocooler may share one or more compressor components. If both systems require different pressures, then a booster may be used to raise the pressure in one of the systems. In some embodiments, the compressor 402 for the pulse tube is provided externally to the continuous flow helium refrigerator 106 as part of the gas handling system 105.

Figure 5:
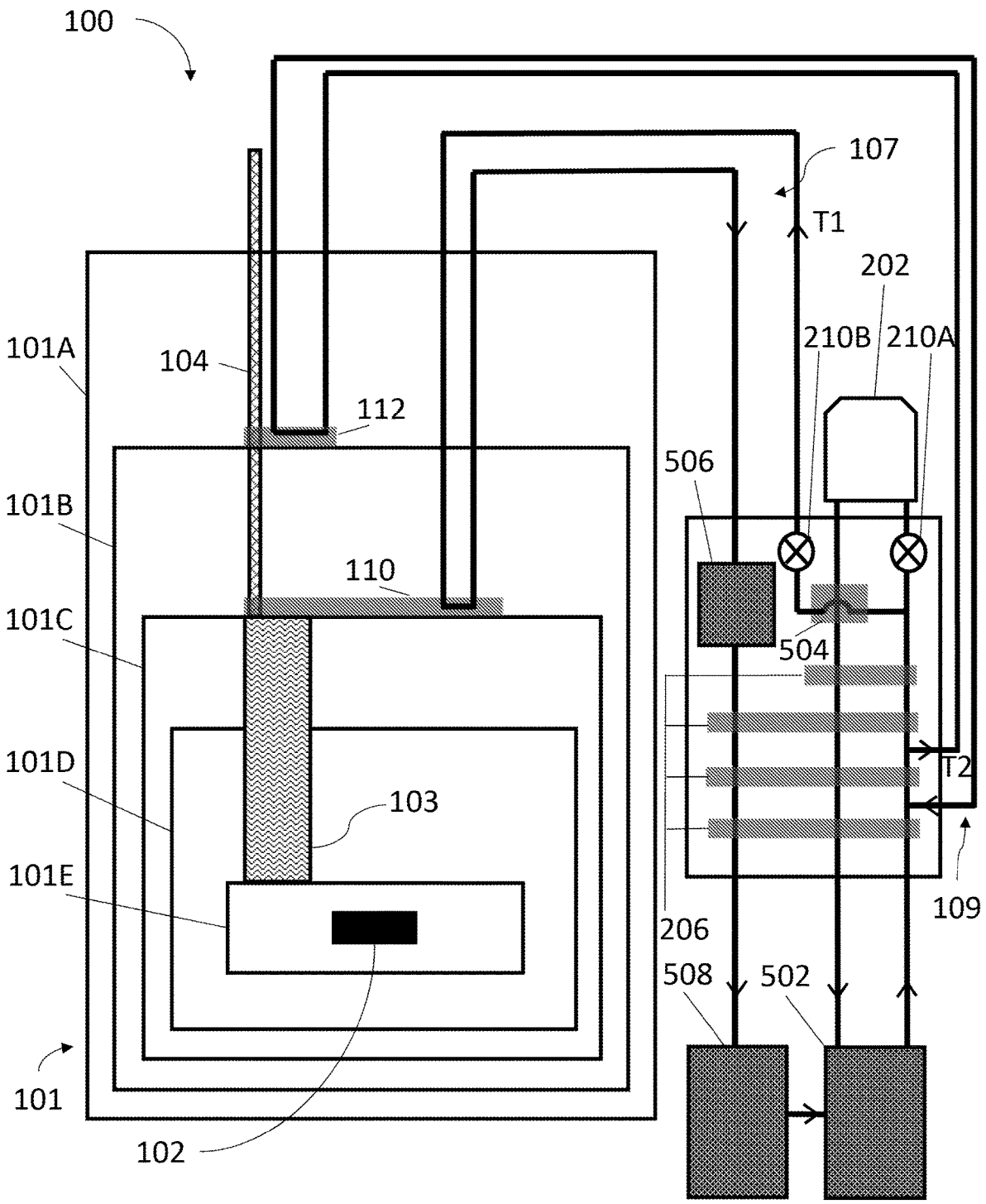
FIG. 5 is a schematic view of a dilution refrigerator according to another embodiment.

Referring to FIG. 5, there is shown another embodiment of a dilution refrigerator 100. In this embodiment, a modified continuous flow helium refrigerator 106 is operable to cool the flange 101C to temperatures below 4.5 K. A compressor 502 compresses warm helium, which then flows through a series of heat exchangers 206 where the helium is cooled. A portion of the cooled compressed helium gas passes through a first expander 210A to condense the helium gas into liquid helium, which then accumulates in the liquid helium reservoir 202. Another portion of the cooled compressed helium gas exiting the heat exchangers 206 is diverted towards an additional heat exchanger 504, which is cooled by cold liquid helium exiting the liquid helium reservoir 202 and flowing towards the compressor 502. In other cases, the additional heat exchanger 504 may be disposed within the liquid helium reservoir 202. The diverted helium gas is then directed through a second expander 210B to produce liquid helium at temperatures at around just below 2 K. This liquid helium, at temperature T1, is directed through first closed loop piping circuit 107 to cool the flange 101C (via heat exchanger flange 110) as well as the 3He supply line 104.

As the helium gas returning from heat exchanger 110 via first closed loop piping circuit 107 has a low density, a compressor 506 is provided to compress this returning helium gas. The helium gas is then passed through at least some of the heat exchangers 206 to provide cooling to the helium gas exiting the compressor 502, before being compressed by a room temperature vacuum compressor 508 and then being fed to the compressor 502. As in previous embodiments, gaseous helium at temperature T2 may be diverted partway through the heat exchangers 206 via second closed loop piping circuit 109 to cool one or more additional flanges, for instance flange 101B via heat exchanger 112.

The helium liquefier shown in FIG. 5 therefore includes two interacting closed loops of circulating helium. The first closed loop includes compressor 502, heat exchangers 206, expander 210A and liquid helium reservoir 202. The second closed loop shares part of the first loop's path, i.e., the compressor 502 and the heat exchangers 206, but is then diverted (for example using orifices/valves) through additional heat exchanger 504 and expander 210B before following through first closed loop piping circuit 107 to the cryostat 101. Returning helium then passes through compressor 506, some or all of heat exchangers 206, and then room temperature vacuum compressor 508 before returning to the compressor 502.

Figure 6:
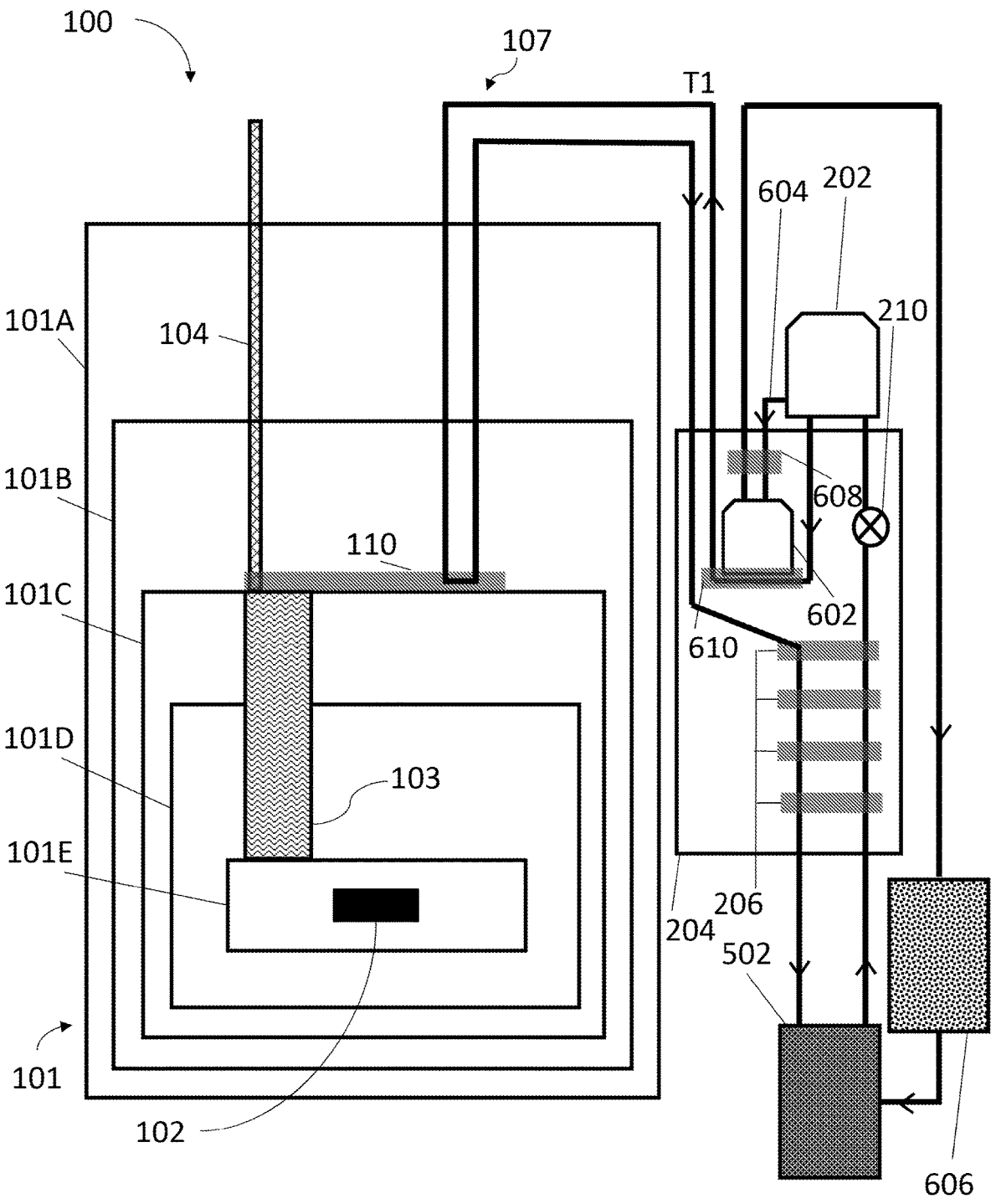
FIG. 6 is a schematic view of a dilution refrigerator according to another embodiment.

Referring to FIG. 6, there is shown another embodiment of a dilution refrigerator 100 with a modified continuous flow helium refrigerator 106 operable to cool the flange 101C to temperatures below 4.5 K. As in previous embodiments, a compressor 502 compresses warm helium gas, which is then directed through a series of heat exchangers 206 for cooling. The cool compressed helium gas is then directed through expander 210 where it is condensed into liquid before accumulating in liquid helium reservoir 202. A portion of the liquid helium from the liquid helium reservoir 202 is diverted to a second liquid helium reservoir 602 via piping 604. Piping 604 includes an impedance to limit the flow of liquid helium towards second liquid helium reservoir 602. The second liquid helium reservoir 602 is fluidly coupled to a downstream vacuum pump 606 which is operable to lower the pressure of the liquid helium in helium reservoir 602. As such, the second liquid helium reservoir 602 forms a liquid helium bath at a temperature of about 1 to 2 K. In some cases, a compressor (not shown) may additionally be provided in the cold block 204 between the second liquid helium reservoir 602 and the vacuum pump 606 to assist the vacuum pump 606 in achieving a desired flow rate. As shown in FIG. 6, the input and output lines of the second liquid helium reservoir 602 may exchange heat via additional heat exchanger 608.

The second liquid helium reservoir 602, i.e., the cold helium bath, is operable to cool, via another heat exchanger 610, the remainder of the liquid helium exiting the liquid helium reservoir 202. This additionally-cooled liquid helium is then circulated via first closed loop piping circuit 107, at temperature T1, to provide cooling to the flange 101C (via heat exchanger 110) and the 3He supply line 104. The returning helium from the cryostat is directed through heat exchangers 206 and then back to the compressor 502. The discharge from the vacuum pump 606 is also directed into the compressor 502, thereby forming a second pathway to the compressor 502. Cooling means for flange 101B are omitted from FIG. 6 for clarity but may include any of the above-described cooling means for flange 101B.

Figure 7:
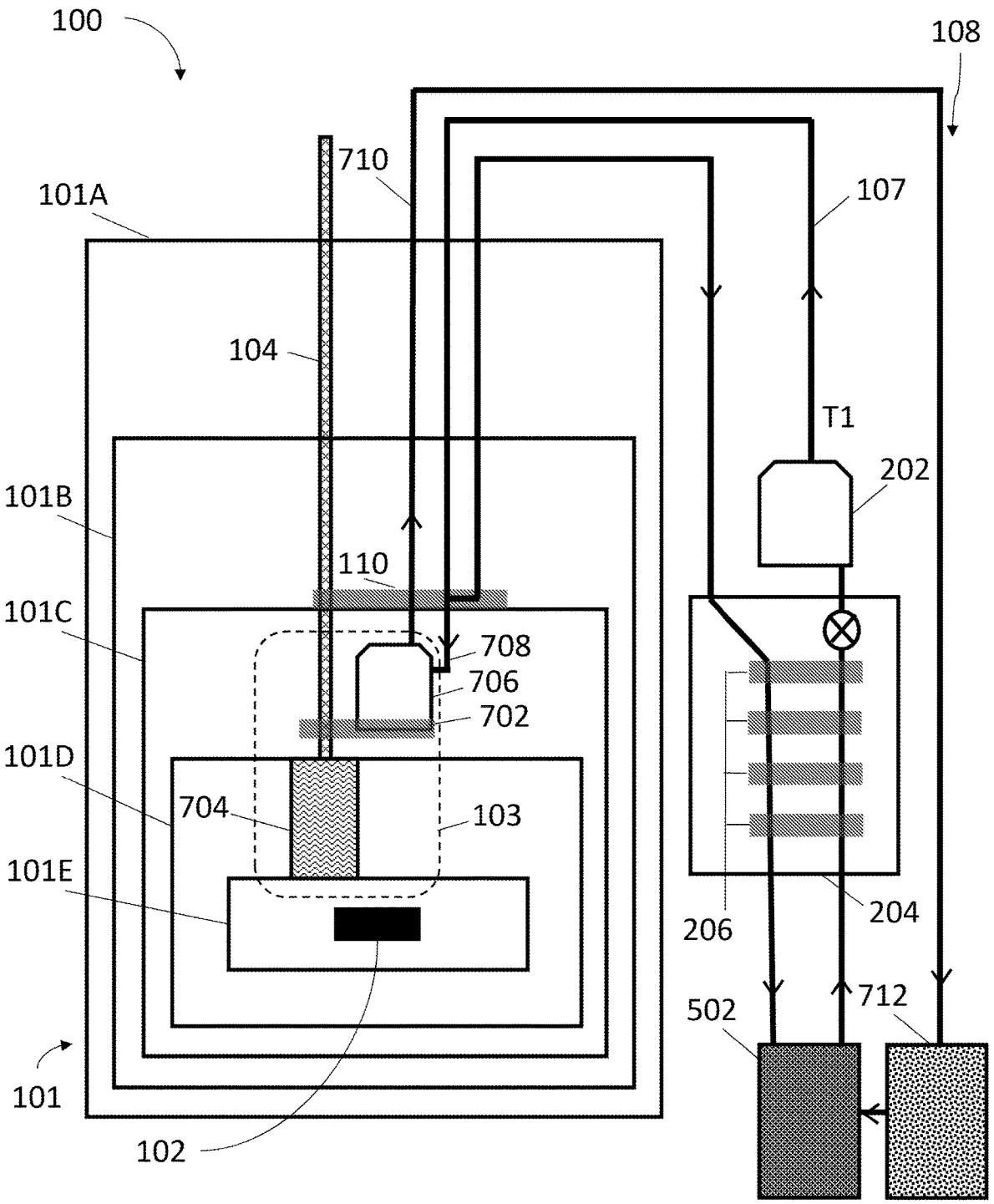
FIG. 7 is a schematic view of a dilution refrigerator according to another embodiment.

Referring to FIG. 7, in another embodiment of a dilution refrigerator 100, cooling of the flange 101C and dilution unit 3He supply line 104 is provided by a continuous flow helium liquefier 108, as described above, fluidly coupled to the heat exchanger 110. As was the case in the embodiment shown in FIG. 6, cooling means for flange 101B are omitted from FIG. 7 for clarity but may include any of the above-described cooling means for flange 101B.

The dilution unit 103, operable to cool the first group of flanges including innermost flange 101E, illustratively includes a heat exchanger 702 acting as a condenser, as well as a still, some counter-flow heat exchangers, and a mixing chamber 704. In this embodiment, the heat exchanger 702, which is used to condense the 3He from the 3He supply line 104, is cooled by a liquid 4He bath 706.

As the liquid 4He in the bath is evaporated in order to cool the supply of 3He, the 4He bath 706 employs a continuous supply of liquid 4He. As the helium liquefier 108 is producing liquid helium to cool the flange 101C and 3He supply line 104, the supply of liquid 4He used for the 4He bath 706 may be drawn from the first closed loop piping circuit 107. As such, a supply line 708 is operable to divert a small quantity of liquid 4He from the first closed loop piping circuit 107 towards the liquid 4He bath 706. In some cases, the supply line 708 may include an impedance tube to limit the flow of 4He towards the liquid 4He bath. While the supply line 708 is shown in FIG. 7 as branching out from first closed loop piping circuit 107 adjacent the heat exchanger 110, it is understood that supply line 708 may branch off from the first closed loop piping circuit 107 at any point of the first closed loop piping circuit 107. In some cases, the supply line 708 may be fluidly connected directly to the liquid helium reservoir 202.

4He evaporated from the liquid 4He bath 706 may be pumped through a return line 710 by a downstream vacuum pump 712 before it returns to the compressor 502. As such, the evaporated 4He may be liquefied in the helium liquefier 108 in a closed loop. In some cases, to attain specific flow rates, a cryogenic compressor may be provided. In such cases, the cryogenic compressor may be disposed in the outer vacuum can 101A, within the appropriate flange for the desired operating temperature of the cryogenic compressor, and on the return line 710 between the liquid 4He bath 706 and the vacuum pump 712. Alternatively, in cases where the return line 710 passes through the cold block 204, the cryogenic compressor may be located inside the cold block 204. In such cases, if the return line 710 were coupled to the heat exchangers 206, the cold helium in the return line 710 may be used to provide cooling to the incoming compressed helium exiting the compressor 502, thus recuperating cooling power from the return line 710 to improve the efficiency of the helium liquefier 108.

Figure 8:
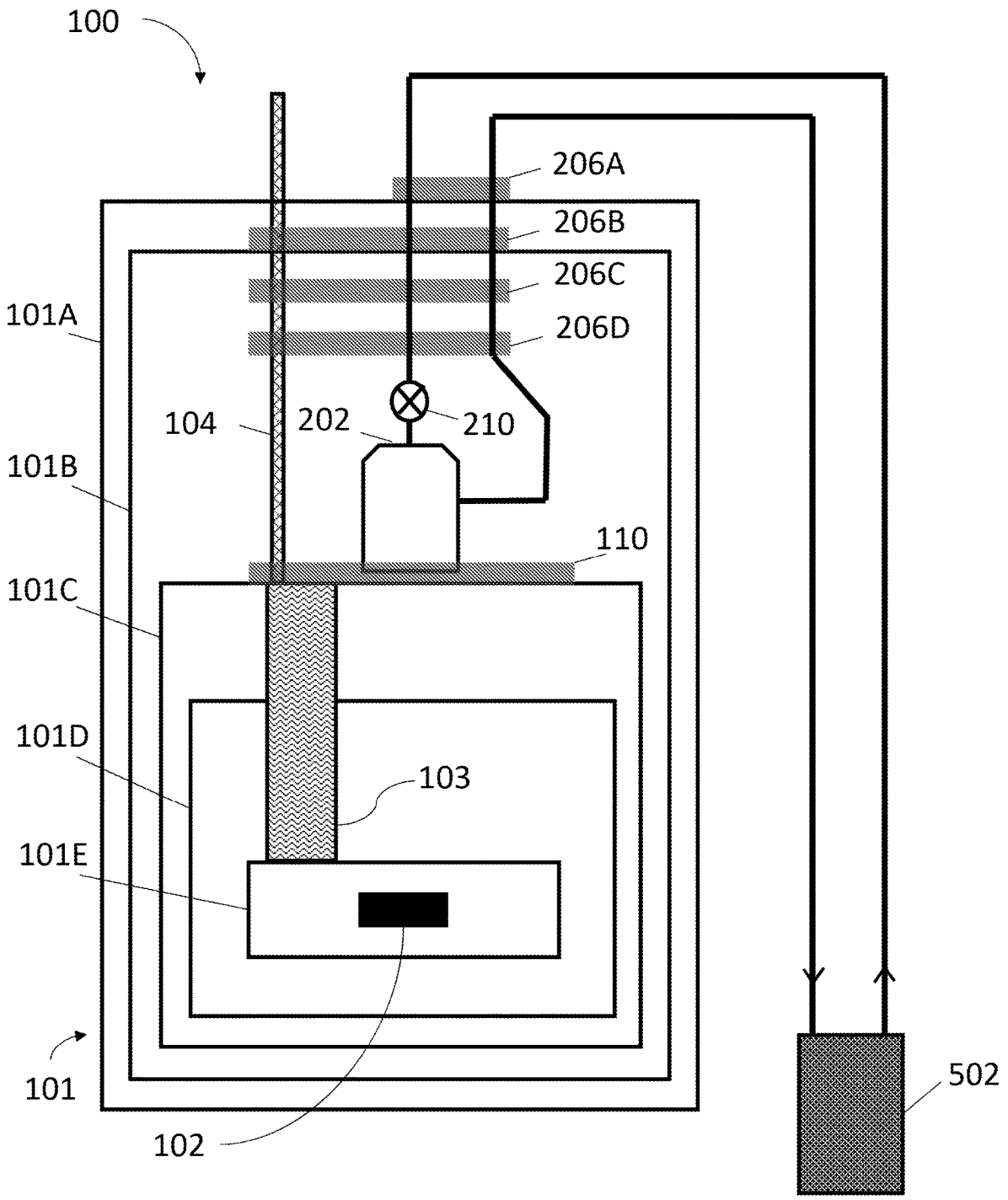
FIG. 8 is a schematic view of a dilution refrigerator according to another embodiment.

In various embodiments, one or more components of the helium liquefier 108 may be disposed inside the cryostat 101. For instance, FIG. 8 shows a dilution refrigerator 100 in which the cold block of the continuous flow helium liquefier is integrated inside the vacuum can 101A. In FIG. 8, the first heat exchanger 206A, which is at room temperature, is positioned outside the vacuum can 101A. In other cases, the first heat exchanger 206A may be positioned inside the vacuum can 101A. The additional heat exchangers 206B, 206C and 206D, are positioned inside the vacuum can 101A rather than in a cold block as in the previous embodiments. While four heat exchangers 206 are shown in FIG. 8, it is understood that other numbers of heat exchangers may be contemplated. One of these heat exchangers, illustratively the heat exchanger 206B, may be operable to cool the flange 101B and the dilution unit 3He supply line 104. The heat exchangers 206C and 206D, which have a lower temperature, are positioned underneath or inside the flange 101B. They may also be operable to cool the dilution unit 3He supply line 104, as shown in FIG. 8. The expander 210 and the liquid helium reservoir 202 are also inside or within the flange 101B and provide cold helium that is used to cool the flange 101C by means of the heat exchanger 110.

The various proposed solutions for providing cooling at the different stages in FIGS. 1-8 may be interchanged. Different solutions can also be combined at any given temperature stage to provide more cooling, or as additional stages to provide cooling at intermediate temperatures. For example, the second closed loop piping circuit 109 may be replaced with a capillary heat pipe and filled with a liquid having a boiling point near the target temperature of the heat exchangers 112, 206A. The combinations shown in the figures are only examples of possible combinations.

The above description is meant to be exemplary only, and one skilled in the art will recognize that changes may be made to the embodiments described without departing from the scope of the disclosure. Still other modifications which fall within the scope of the present disclosure will be apparent to those skilled in the art, in light of a review of this disclosure.

Various aspects of described herein may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments. The scope of the following claims should not be limited by the embodiments set forth in the examples but should be given the broadest reasonable interpretation consistent with the description as a whole.

The invention claimed is:

1. A dilution refrigerator comprising:

a cryostat comprising a plurality of temperature-controlled flanges inside a vacuum chamber, the temperature-controlled flanges including a first group of flanges cooled to a first set of progressively lower temperatures and a second group of flanges cooled to a second set of progressively lower temperatures that are higher than the first set of progressively lower temperatures;

a dilution unit disposed inside the cryostat and operable to cool the first group of flanges to the first set of progressively lower temperatures; and a continuous flow helium refrigerator in heat transfer communication with a lowest temperature flange of the second group of flanges to provide primary cooling thereto to a first temperature, the continuous flow helium refrigerator residing at least partially in the cryostat and comprising a helium liquefier and a first closed-loop circuit thermally coupling the helium liquefier to the lowest temperature flange of the second group of flanges, the helium liquefier including a compressor, an expander downstream from the compressor, at least one heat exchanger between the compressor and the expander, and a liquid helium reservoir downstream from the expander and providing liquid helium to the lowest temperature flange of the second group of flanges via the first closed-loop circuit, a portion of the first closed-loop circuit outside the helium liquefier being engaged to the lowest temperature flange to provide heat transfer from the lowest temperature flange to the liquid helium flowing in said portion of the first closed-loop circuit.

2. The dilution refrigerator of claim 1, wherein the continuous flow helium refrigerator further comprises a second closed-loop circuit thermally coupled to the at least one heat exchanger, the second closed-loop circuit thermally coupling the continuous flow helium refrigerator to one or more flanges of the second group of flanges to provide cooling thereto to a second temperature.

3. The dilution refrigerator of claim 2, wherein the second closed-loop circuit provides liquid nitrogen to the one or more flanges of the second group of flanges.

4. The dilution refrigerator of claim 2, wherein the second closed-loop circuit diverts compressed Helium gas exiting the compressor to cool the one or more flanges of the second group of flanges to the second temperature.

5. The dilution refrigerator of claim 1, further comprising a second expander coupled to the first closed-loop circuit between an inlet of a first compressor component of the compressor and an outlet of a second compressor component of the compressor.

6. The dilution refrigerator of claim 1, further comprising a pulse tube cryocooler providing additional cooling to the second group of flanges at a second temperature higher than the first temperature.

7. The dilution refrigerator of claim 1, wherein the helium liquefier further includes a second expander and a second heat exchanger, the second heat exchanger operable to cool, via liquid helium in the liquid helium reservoir, a portion of helium diverted downstream of the at least one heat exchanger to a second temperature below the first temperature and direct the portion of helium through the second expander and through the first closed-loop circuit.

8. The dilution refrigerator of claim 1, wherein the helium liquefier further includes a second liquid Helium reservoir thermally coupled to a second heat exchanger, the second liquid Helium reservoir operable to receive a portion of liquid Helium from the liquid Helium reservoir, with a remainder of the liquid helium from the liquid Helium reservoir diverted to the second heat exchanger to cool the portion of liquid Helium before the portion of liquid Helium is directed through the first closed-loop circuit.

9. The dilution refrigerator of claim 1, wherein the dilution unit includes a second liquid helium reservoir thermally coupled to a second heat exchanger and disposed in the first group of flanges, the second liquid helium reservoir operable to receive liquid helium from the liquid helium reservoir and provide cooling, via the second heat exchanger, to a flange of the second group of flanges and/or a supply line to the dilution unit.

10. The dilution refrigerator of claim 1, wherein the expander, the at least one heat exchanger, and the liquid helium reservoir are disposed inside the cryostat.

11. A dilution refrigerator comprising:

a cryostat comprising a plurality of temperature-controlled flanges inside a vacuum chamber, the temperature-controlled flanges composed of a first group of flanges cooled to a first set of progressively lower temperatures and a second group of flanges cooled to a second set of progressively lower temperatures that are higher than the first set of progressively lower temperatures;

a dilution unit disposed inside the cryostat and operable to cool the first group of flanges to the first set of progressively lower temperatures; and a continuous flow helium refrigerator in heat transfer communication with a lowest temperature flange of the second group of flanges to maintain the lowest temperature flange at a first temperature of 2.5 K to 5 K using a recuperative thermodynamic cycle, the continuous flow helium refrigerator residing at least partially in the cryostat and including a helium liquefier and a first closed-loop circuit fluidly interconnecting the helium liquefier and the lowest temperature flange of the second group of flanges, a portion of the first closed-loop circuit outside the helium liquefier being engaged to the lowest temperature flange to provide heat transfer from the lowest temperature flange to the liquid helium flowing in said portion of the first closed-loop circuit.

12. The dilution refrigerator of claim 11, wherein the continuous flow helium refrigerator further comprises a second closed-loop circuit thermally coupled to the helium liquefier, the second closed-loop circuit thermally coupling the continuous flow helium refrigerator to one or more flanges of the second group of flanges to provide cooling thereto to a second temperature.

13. The dilution refrigerator of claim 12, wherein the second closed-loop circuit diverts compressed Helium gas from the helium liquefier to cool the one or more flanges of the second group of flanges to the second temperature.

14. The dilution refrigerator of claim 11, further comprising a pulse tube cryocooler providing additional cooling to the second group of flanges at a second temperature higher than the first temperature.

15. The dilution refrigerator of claim 11, wherein the helium liquefier includes a compressor, an expander downstream from the compressor, at least one heat exchanger between the compressor and the expander, and a liquid helium reservoir downstream from the expander and providing liquid helium to the lowest temperature flange of the second group of flanges via the first closed-loop circuit.

16. The dilution refrigerator of claim 15, further comprising a second expander coupled to the first closed-loop circuit between an inlet of a first compressor component of the compressor and an outlet of a second compressor component of the compressor.

17. The dilution refrigerator of claim 15, wherein the helium liquefier further includes a second expander and a second heat exchanger, the second heat exchanger operable to cool, via liquid helium in the liquid helium reservoir, a portion of helium diverted downstream of the at least one heat exchanger to a second temperature below the first temperature and direct the portion of helium through the second expander and through the first closed-loop circuit.

18. The dilution refrigerator of claim 15, wherein the helium liquefier further includes a second liquid Helium reservoir thermally coupled to a second heat exchanger, the second liquid Helium reservoir operable to receive a portion of liquid Helium from the liquid Helium reservoir, with a remainder of the liquid helium from the liquid Helium reservoir diverted to the second heat exchanger to cool the portion of liquid Helium before the portion of liquid Helium is directed through the first closed-loop circuit.

19. The dilution refrigerator of claim 15, wherein the dilution unit includes a second liquid helium reservoir thermally coupled to a second heat exchanger and disposed in the first group of flanges, the second liquid helium reservoir operable to receive liquid helium from the liquid helium reservoir and provide cooling, via the second heat exchanger, to a flange of the second group of flanges and/or a supply line to the dilution unit.

20. The dilution refrigerator of claim 15, wherein the expander, the at least one heat exchanger, and the liquid helium reservoir are disposed inside the cryostat.

21. A continuous flow helium refrigerator for a dilution refrigerator of a quantum computing system, comprising:

a helium liquefier including a compressor, an expander downstream from the compressor, at least one heat exchanger between the compressor and the expander, and a liquid helium reservoir downstream from the expander; and a closed-loop circuit thermally coupling the helium liquefier to a flange of the dilution refrigerator;

wherein the helium liquefier is operable to maintain the flange of the dilution refrigerator at a temperature of 2.5 K to 5 K.

* * * * *